US008162531B2

(12) United States Patent
Crump

(10) Patent No.: US 8,162,531 B2
(45) Date of Patent: Apr. 24, 2012

(54) MIXING SYSTEM FOR INCREASED HEIGHT TANKS

(75) Inventor: J. Mark Crump, Elburn, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 1130 days.

(21) Appl. No.: 11/425,938

(22) Filed: Jun. 22, 2006

(65) Prior Publication Data

US 2006/0291326 A1 Dec. 28, 2006

Related U.S. Application Data

(60) Provisional application No. 60/693,259, filed on Jun. 22, 2005.

(51) Int. Cl.
*B01F 5/02* (2006.01)

(52) U.S. Cl. ..... 366/137; 366/165.5; 366/173.2

(58) Field of Classification Search ..... 366/136, 366/137, 165.1–165.5, 167.1, 173.1, 173.2, 366/174.1, 175.2; 162/248–249
See application file for complete search history.

(56) References Cited

U.S. PATENT DOCUMENTS 401,610 A * 4/1889 Tomkins ..... 162/249
430,242 A * 6/1890 Way ..... 134/198
486,339 A * 11/1892 Johnston et al. ..... 162/65
626,950 A * 6/1899 Wheelwright ..... 366/134
981,098 A * 1/1911 McCaskell ..... 422/224
1,026,578 A * 5/1912 Hammond ..... 366/137
1,061,767 A * 5/1913 Stanley ..... 162/249
1,073,878 A * 9/1913 Trent ..... 366/137
1,192,478 A * 7/1916 Vandercook ..... 209/66
1,309,267 A * 7/1919 Westad et al. ..... 162/249
1,470,188 A * 10/1923 Pryde ..... 366/165.5
1,548,477 A * 8/1925 Morterud ..... 162/249
1,580,476 A * 4/1926 Fassio ..... 68/184
1,716,294 A * 6/1929 Bond ..... 366/134
1,777,217 A * 9/1930 Morterud ..... 162/248
1,790,347 A * 1/1931 Hawkins ..... 366/165.3
1,807,544 A * 5/1931 Morterud ..... 162/249
1,831,206 A * 11/1931 Swanson et al. ..... 162/42
1,858,591 A * 5/1932 Hovey ..... 162/249

(Continued)

FOREIGN PATENT DOCUMENTS

WO WO 2007/002129 A2 * 1/2007

OTHER PUBLICATIONS

International search report and opinion for PCT/US06/24046 (WO 2007/002129).*

*Primary Examiner* — Charles E Cooley

(57) ABSTRACT

A system for mixing the solid and liquid contents of a tank having an increased height using at least one flow generating device positioned proximate an outer wall of the tank and directed in a direction to discharge a flow having a rotational component and a generally upward component. A plurality of such flow generating devices may be positioned in one or more rings at various elevations within the tank. The flow generating devices are positioned such that resultant fluid flows within the tank contents include a flow in a generally rotational direction and a flow having components generally upward in the outer portion of the tank, inward in the upper portion of the tank, downward in the center portion of the tank, and outward in the lower portion of the tank.

22 Claims, 2 Drawing Sheets

U.S. PATENT DOCUMENTS 1,878,825 A * 9/1932 Caise ..... 68/184
1,883,597 A * 10/1932 Cowles ..... 366/137
1,905,731 A * 4/1933 Mckee ..... 162/61
1,909,487 A * 5/1933 Cowles ..... 68/184
1,944,836 A * 1/1934 Cowles ..... 366/137
1,954,625 A * 4/1934 Hellstrom ..... 162/243
2,545,640 A * 3/1951 Aitken ..... 169/45
2,603,460 A * 7/1952 Kalinske ..... 366/173.2
2,633,436 A * 3/1953 Martin ..... 127/28
2,900,176 A * 8/1959 Krogel ..... 366/137
2,969,225 A * 1/1961 Jenks ..... 366/137
3,078,999 A * 2/1963 Kelly ..... 210/194
3,098,704 A * 7/1963 Schoppe ..... 423/659
3,109,630 A * 11/1963 Nichols ..... 366/165.4
3,271,304 A * 9/1966 Cox et al. ..... 210/621
3,334,868 A * 8/1967 Lage ..... 366/136
3,386,182 A * 6/1968 Lippert ..... 34/364
3,495,949 A * 2/1970 Niedner et al. ..... 422/224
3,586,294 A * 6/1971 Strong ..... 366/163.2
3,647,357 A * 3/1972 Niedner et al. ..... 423/659
3,741,533 A * 6/1973 Winn, Jr. ..... 366/136
3,846,079 A * 11/1974 Alagy et al. ..... 422/234
3,871,272 A * 3/1975 Melandri ..... 99/276
4,097,026 A * 6/1978 Haindl ..... 366/165.2
4,117,550 A * 9/1978 Folland et al. ..... 366/136
4,146,468 A * 3/1979 Wilson ..... 209/725
4,187,029 A * 2/1980 Canale et al. ..... 366/153.1
4,285,602 A * 8/1981 Hagerty et al. ..... 366/181.6
4,290,884 A * 9/1981 Mandt ..... 210/195.3
4,332,484 A * 6/1982 Peters ..... 366/137
4,337,069 A * 6/1982 German et al. ..... 96/266
4,340,308 A * 7/1982 Tharp ..... 366/2
4,415,267 A * 11/1983 Hill ..... 366/14
4,491,414 A * 1/1985 Hayatdavoudi et al. ..... 366/6
4,512,665 A * 4/1985 Cline et al. ..... 366/173.2
4,618,426 A * 10/1986 Mandt ..... 210/620
4,621,928 A * 11/1986 Schreiber ..... 366/137
4,812,045 A * 3/1989 Rivers ..... 366/107
4,820,053 A * 4/1989 Rivers ..... 366/137
5,046,856 A * 9/1991 McIntire ..... 366/291
5,050,995 A * 9/1991 Lucore, II ..... 366/136
5,057,230 A * 10/1991 Race ..... 210/758
5,253,937 A * 10/1993 Scheimann et al. ..... 366/136
5,338,779 A * 8/1994 Brazelton ..... 523/313
5,374,119 A * 12/1994 Scheimann ..... 366/101
5,458,414 A * 10/1995 Crump et al. ..... 366/137
5,609,417 A * 3/1997 Otte ..... 366/137
5,615,950 A * 4/1997 Frei et al. ..... 366/173.1
5,658,076 A * 8/1997 Crump et al. ..... 366/270
5,735,600 A * 4/1998 Wyness et al. ..... 366/101
5,899,560 A * 5/1999 Byers ..... 366/137
6,065,860 A * 5/2000 Fuchsbichler ..... 366/136
6,109,778 A * 8/2000 Wilmer ..... 366/137
6,217,207 B1 * 4/2001 Streich et al. ..... 366/137
6,241,897 B1 * 6/2001 Hanson et al. ..... 210/739
6,250,796 B1 * 6/2001 Huang ..... 366/270
6,357,906 B1 * 3/2002 Baudoin et al. ..... 366/163.2
6,361,202 B1 * 3/2002 Lee et al. ..... 366/165.2
6,488,402 B1 * 12/2002 King et al. ..... 366/173.2
6,536,468 B1 * 3/2003 Wilmer et al. ..... 137/544
6,769,261 B2 * 8/2004 Gustavsson et al. ..... 62/56
6,821,011 B1 * 11/2004 Crump ..... 366/137
6,866,411 B1 * 3/2005 Stelzer et al. ..... 366/136
6,997,599 B2 * 2/2006 Gallup ..... 366/176.1
7,134,781 B2 * 11/2006 Roberts et al. ..... 366/137
7,229,207 B2 * 6/2007 Graham, Sr. ..... 366/348
7,267,232 B2 * 9/2007 Khan et al. ..... 209/170
7,862,225 B2 * 1/2011 Betchan et al. ..... 366/153.1
2002/0105855 A1 * 8/2002 Behnke et al. ..... 366/167.1
2005/0281131 A1 * 12/2005 Yungblut ..... 366/137
2006/0114744 A1 * 6/2006 White et al. ..... 366/101
2006/0245295 A1 * 11/2006 Dorsch et al. ..... 366/165.1
2006/0291326 A1 * 12/2006 Crump ..... 366/137
2007/0258318 A1 * 11/2007 Lamon ..... 366/167.1
2008/0062812 A1 * 3/2008 Braden ..... 366/134
2008/0151684 A1 * 6/2008 Lamon ..... 366/173.1

* cited by examiner

MIXING SYSTEM FOR INCREASED HEIGHT TANKS

CROSS-REFERENCE TO RELATED APPLICATION

This application claims priority from U.S. Patent Application Ser. No. 60/693,259, filed on Jun. 22, 2005, the disclosure of which is hereby incorporated by reference in its entirety.

FIELD

The apparatus and methods described herein relate generally to tank mixing systems and, in particular, to tank mixing systems for sludge storage tanks and digester tanks having increased heights.

BACKGROUND

Storage tanks are often used for municipal and industrial sludge and other applications, such as storing sludge from municipal and industrial waste treatment facilities. The sludge generally comprises both solid and liquid components. The storage tanks may be used for storing the sludge when received from a waste treatment facility prior to processing and after processing. In addition, storage tanks may be used for treatment processes, such as aerobic and anaerobic digestion.

The storage tanks are typically large, ranging from about 10 feet in diameter up to and beyond 150 feet in diameter. The depths of such tanks likewise have a broad range, varying between about 10 feet to about 40 feet and above. However, tanks having increased heights pose unique problems as compared to typical tanks having lower heights.

Due to the mixture of liquid and solid components forming the sludge, and the large volumes of sludge frequently present in the tanks, settling of the solid components relative to the liquid components often occurs. The solid components of the sludge tend to settle in a layer toward the bottom of the tank over time, while the liquid contents remain above the accumulated solid layer on the bottom floor of the tank. In order to facilitate removal and/or further processing of the sludge in the tank, including both liquid and solid components, it is desirable to break up the solid layer on the bottom floor of the tank and resuspend the solid components into the liquid components. Such resuspension involves mixing of the tank contents to move the solid components from the floor in order to create a generally homogenous liquid and solid slurry within the tank. A variety of mixing systems aimed at suspending the solid components back into the liquid components of the sludge have been developed. In some instances, flow patterns are developed within the tanks in order to mix the solid and liquid components of the tank contents together in an efficient and effective manner. One such system for typical tanks having lower heights is disclosed in U.S. Pat. No. 5,458,414, the disclosure of which is hereby incorporated by reference in its entirety.

SUMMARY

There is provided a new improved method and apparatus for mixing the liquid and solid components of the contents of a tank having an increased height using a tank mixing system. This is achieved by directing streams or jets of fluid using at least one directed flow generated device positioned in the outer region of the tank. The flow generating devices may be positioned at an angle that is between horizontal and vertical to generate both a generally rotational flow and a generally upward flow of fluid from the flow generating devices.

A plurality of flow generating devices may be positioned in a ring at a predetermined elevation of the tank, and may be positioned proximate the sidewall of the tank. Depending upon the height of the tank, a plurality of flow generating device rings may be positioned at different elevations. The generally upwardly directed streams are believed to facilitate fluid flow generally upward in the outer region of the tank, generally inward in the upper region of the tank, generally downward in the inner region of the tank, and generally outward in the lower region of the tank. These flows may be repeated as the contents flow in the rotational flow pattern. In addition, the fluid flows in the outer portion of the tank are believed to follow a generally corkscrew-like path proximate the outer wall of the tank.

The tank may be generally circular in shape having an outer surrounding wall with a radius extending from the center of the tank to the outer surrounding wall. The tank is at least partially filled with contents having both solid and liquid components to a liquid level having a surface. A sump may be provided for withdrawing at least some of the contents from the tank. A pump may be provided having its input connected to the sump for withdrawing at least some of the contents of the tank through the sump. At least one submerged flow generating device, such as a nozzle or a propeller, is positioned within the tank proximate the outer wall and is operatively connected to a discharge of the pump for pumping some of the contents through the submerged flow generating device.

An upper flow generating device, such as nozzle, may be positioned at an elevation above the liquid level of the tank contents and aimed to selectively discharge at least some of the contents into the tank at a downward angle relative to the surface of the liquid contents and tangent to a generally circular band on the surface between the tank outer surrounding wall and the center of the tank.

The flow generating devices may be submerged beneath the surface of the tank contents and the upper flow generating device may be positioned a distance spaced above the surface of the tank contents. A pump may be operatively connected between the tank and the flow generating device for selectively drawing at least some of the contents from the tank and discharging them through the upper flow generating device.

In one aspect, a plurality of the submerged flow generating devices may be positioned within a ring disposed proximate the outer wall of the tank. The submerged flow generating devices may be positioned between 75% and 100% of the radial distance from the center of the tank to the tank sidewall.

In another aspect, a plurality of rings of submerged flow generating devices may be positioned at different elevations of the tank. A flow generating device, such as a jet nozzle, may be provided for at least every 300,000 gallons of tank contents. Where multiple rings of submerged flow generating devices are present in the tank, they may be separated by between 30 and 50 feet vertically, and the lowest ring may be between 25 and 35 feet above the lowest point in the tank.

In yet another aspect, an upper flow generating device is positioned above the fluid level in the tank and is directed downwardly towards the upper surface of the fluid level in the tank. The upper flow generating device is operatively connected to the pump that withdraws at least some of the contents from the tank through the sump for selective discharge through the upper flow generating device. The submerged flow generating devices are believed to create a fluid flow within the tank having a flow moving the tank contents in a direction of rotation along with a generally inward component and a generally outward component proximate the surface of the tank contents, the generally inward and outward components of the fluid flow meeting in a region of the tank, and the upper flow generating device being positioned to direct a stream of fluid onto the surface generally at the region of the tank where the generally inward and outward components of the fluid flow meet.

According to another aspect, a system is provided for mixing liquid and solid components of contents of a tank. The system includes a tank at least partially filled with the contents, a sump for withdrawing at least some of the contents of the tank, and a pump having an input operatively connected to the sump for withdrawing the contents of the tank from the sump. In addition, a plurality of submerged flow generating devices are positioned in a ring proximate the outer wall of the tank and are operatively connected to a discharge of a pump for pumping at least some of the contents of the tank therethrough. The flow generating devices are positioned to discharge fluid in an orientation believed to be effective to generate flows having a generally rotational component and components that are generally upward in the outer portion of the tank, generally inward in the upper portion of the tank, generally downward in the center portion of the tank and generally outward in the lower portion of the tank.

A method is provided for mixing liquid and solid components of contents of a tank. The method includes pumping at least some of the contents of the tank through a plurality of submerged flow generating devices positioned in a ring proximate an outer wall of the tank. The flow generating devices are positioned to discharge fluid in an orientation between a horizontal direction and a vertical direction believed to generate flows having a generally rotational component and components that are generally upward in the outer portion of the tank, generally inward in the upper portion of the tank, generally downward in the center portion of the tank and generally outward in the lower portion of the tank.

The method may also include the step of directing at least some of the contents of the tank through an upper flow generating device positioned above the fluid level in the tank and directed downwardly toward the upper surface of the fluid level in the tank. The upper flow generating device may be operatively connected to the pump that withdraws at least some of the contents from the tank through the sump for selective discharge through the upper flow generating device.

DETAILED DESCRIPTION OF THE DRAWINGS

Figure 1:
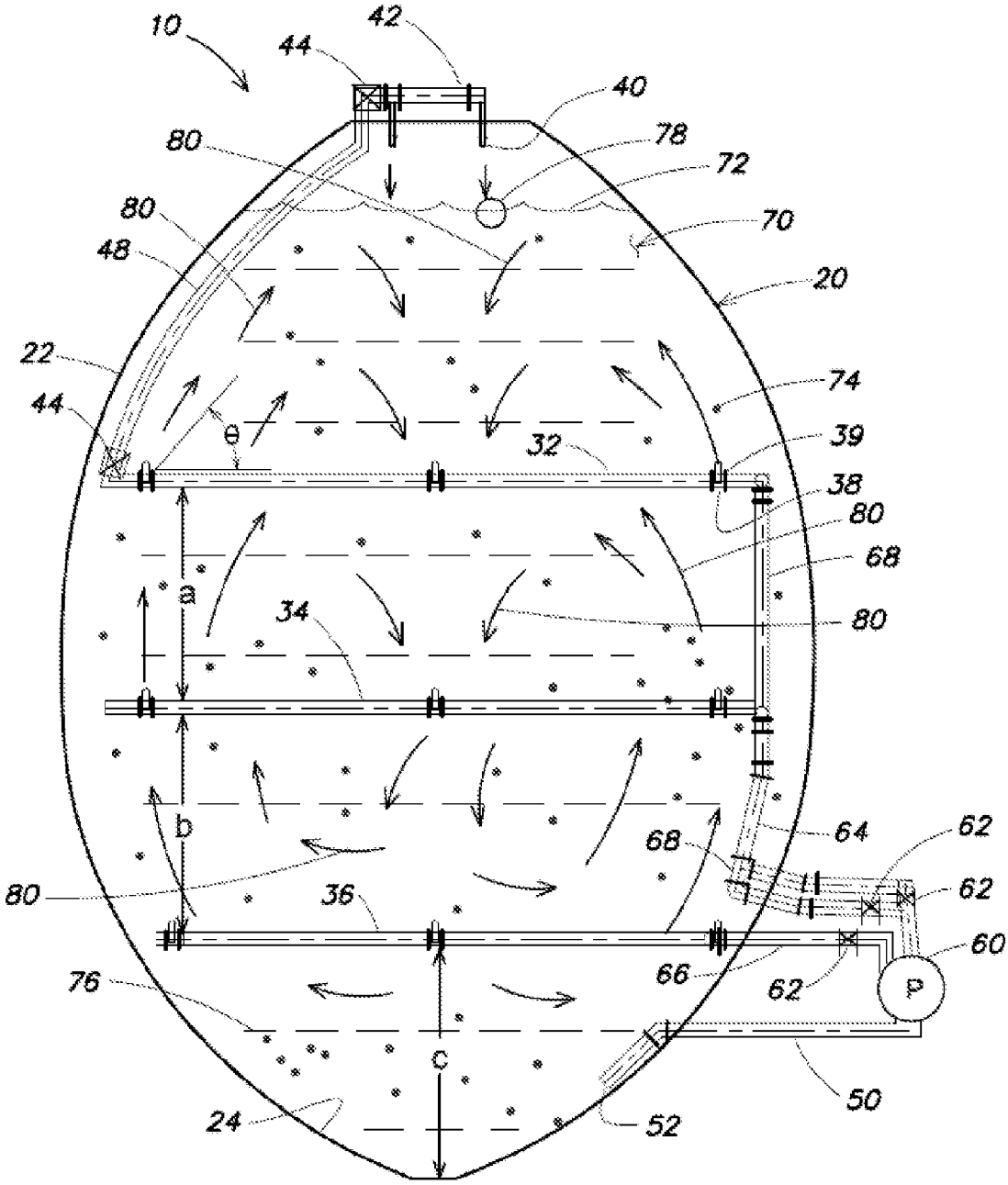
FIG. 1 is a side elevation view of a cross section of a mixing system including submerged nozzles positioned proximate the sidewall of the tank and surface nozzles and showing what are believed to be idealized fluid flow patterns.
Figure 2:
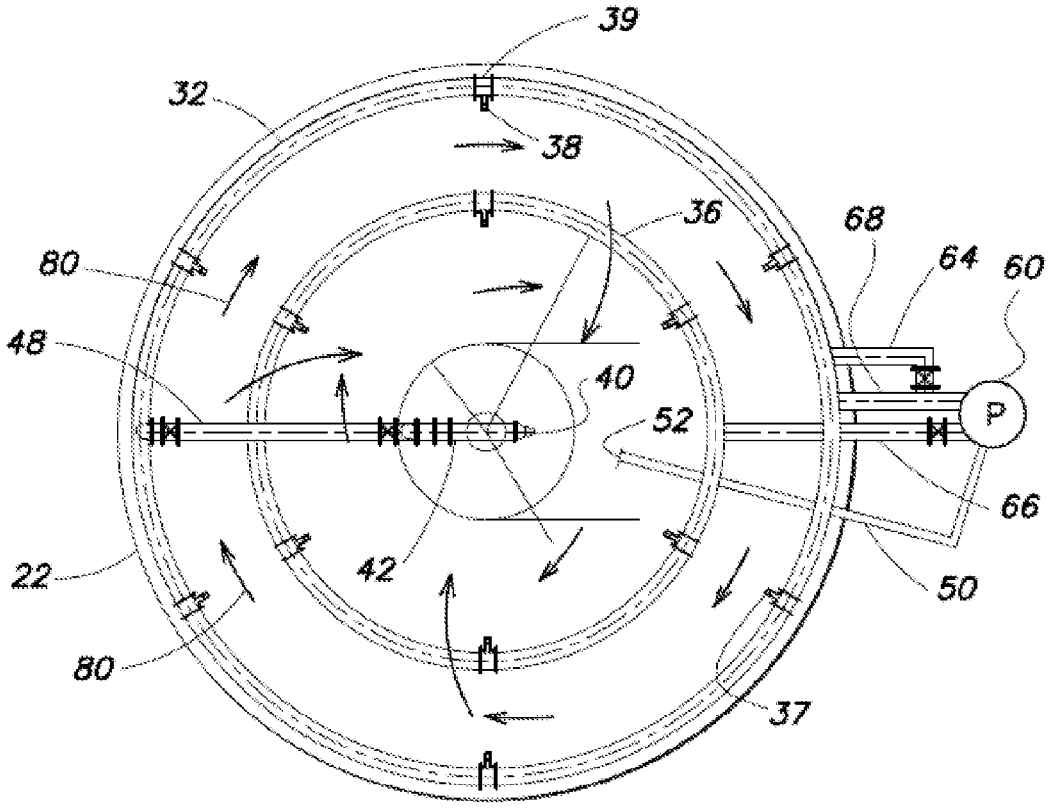
FIG. 2 is a top view of the mixing system of FIG. 1.

As shown in the drawings for purposes of illustration, there is illustrated an embodiment of a tank mixing system for a tank, such as an increased height tank, in FIGS. 1 and 2. The mixing system 10 shown is for mixing solid and liquid components 74 and 76 of contents 70 within a tank 20. Multiple flow generating devices, and in this particular example mixing nozzles 38, are each positioned proximate the sidewall of the tank and arranged in rings 32, 34 and 36 positioned at different elevations within the tank through which streams of fluid are discharged into the tank contents 70. The mixing nozzles 32 are positioned to generate one or more flow patterns within the tank 20 for mixing the solid and liquid components 74 and 76 of the tank contents 70.

The mixing nozzles 38 each include a base 39 for securement to piping forming the rings 32, 34 and 36. The piping forming rings 32, 34 and 36 is attached relative to the tank, such as by securement to any of the outer surrounding wall, the floor or the roof of the tank. Attached relative to the base 39 is the mixing nozzle 38, comprising an elbow shaped pipe having a nozzle outlet 37 at one end through which fluid is discharged into the tank 20. The base 39 may be connected in-line with the piping, such that the fluid flows through the base to flow to other mixing nozzles attached to the rings. The base 39 may include an elbow shaped pipe, or may include a mounting frame and/or footing for attachment of the mixing nozzle 38. The mixing nozzle 38 may be selectively rotatable relative to the base 39, and preferably can be selectively fixed to the base to permit adjustments in the angle of the mixing nozzle 38 to be made during installation of the system.

In order to provide fluid for discharge through the mixing nozzles 38, a sump 52 inside the tank 20 is in communication with the mixing nozzles 38. One or more pumps 60 are positioned outside of the tank outer surrounding wall 22 to draw fluid contents 70 from within the tank 20 via the sump 52. The sump 52 is positioned adjacent the floor 24 of the tank 20, and can be located either above the tank floor 24, as illustrated in FIG. 1, or within the tank floor 24 with an opening in the floor 24 for allowing fluid to exit into the sump 52. Piping 50 extends between the sump 52 and an inlet of the pump 60 for drawing fluid 70 from the tank 20 through the sump 52.

The outlet of the pump 60 is operatively connected to the rings 32, 34 and 36 of mixing nozzles 38 by piping 64, 66 and 68. More specifically, piping 66 extends from an outlet of the pump 60 to the lowermost ring 36 of mixing nozzles 38. Separate piping 64 extends from an outlet of the pump 60 to the middle ring 34 of mixing nozzles 38. Separate piping 68 also extends from an outlet of the pump 60 to the upper ring 32 of mixing nozzles 38. One or more valves 62 may be positioned along the piping 64, 66 and 68 to selectively control the flow of fluid from the outlet of the pump 60 to the mixing rings 32, 34 and 36 and ultimately the mixing nozzles 38. More than one pump 60 can also be used, such as one pump 60 for each of the rings 32, 34 and 36. Instead of piping rings 32, 34 and 36, the mixing nozzles 38 forming a ring could be connected via generally vertical piping.

The pump 60 is preferably of the chopper type, whereby solid components 74 of the solid and liquid components 74 and 76 of the tank contents 70 are withdrawn from within the tank 20 through the sump 52 and agitated to break up the solid components 74 for suspension in the liquid components 76. The pump 60 may have a plurality of vanes through which the contents are drawn that break the solid components 74 into smaller solid components. A preferred type of chopper pump is manufactured by Hayward-Gordon Ltd., 6660 Campobello Road, Mississauga, Ontario, Canada. Another type of chopper pump is manufactured by Vaughan Company, Inc., 364 Monte-Alma Road, Montesano, Wash. Another type of pump is the chop-flow chopper pump manufactured by Weir Specialty Pumps, 440 West 800 South, Salt Lake City, Utah.

The number of mixing nozzles 38 and the number of rings of mixing nozzles within the tank 20 are selected based upon the size of the tank 20 and the characteristics of the contents 70 of the tank 20 to be mixed. For instance, a tank having a larger volume of contents and a larger height may have more mixing nozzles 38 and more rings than a smaller, shorter tank. Thus, generally the higher the tank, the larger the number of mixing nozzles of rings that are provided; and generally the larger the tank volume, the more mixing nozzles that are provided.

Generally, and for typical tank contents, at least one mixing nozzle 38 may be provided for about every 175,000 to 300,000 gallons of tank contents. The nozzles 38 are preferably, though not necessarily, generally spaced in a uniform manner around each of the rings 32, 36 and 38. Although it is preferred that each ring 32, 34 and 36 have the same number of nozzles, one or more of the rings can have a different number of nozzles depending upon the diameter or dimensions of the tank at the location of the ring. The number of mixing nozzles 38 can be determined in part by the rheology of the tank contents 70, which in turn determines the energy input through the nozzles 38. For instance, the kinetic energy gradient ($KE_{gr}$) can be used to determine the number of nozzles 38 desirable for a particular volume of tank. Typical increased height tanks will have a kinetic energy gradient of between about 10 and 25 BHP/million gallons, and generally toward the lower end of that range, although other kinetic energy gradients may fall outside of that range depending upon the particular application. The nozzles may be constructed of stainless steel, such as 316 SS, or may be cast of other materials, such as Ni-Hard. The mixing nozzles are positioned proximate the outer wall 22 of the tank 20, such as between 75% and 100% of the radial distance or between about 5 feet and about 10 feet from the wall 22.

The number of rings of mixing nozzles may vary according to the height of the tank. For example, it is presently believed that a mixing ring may be provided for every about 30 feet to about 50 feet of tank elevation, and the lowermost ring of nozzles may be provided at an elevation of between about 25 feet and about 35 feet from the lowermost point in the tank. Preferably, though not necessarily, the rings 32, 34 and 36 are generally uniformly spaced apart. For example, the tank 20 of FIG. 1 has its upper ring 32 spaced a distance a from the middle ring 34, and its lower ring is spaced a distance b from the lower ring 36, and the spacing distances a and b are about the same. The distance c from the lowest point in the tank 20 to the lowermost ring 36 is also preferably, though not necessarily, about the same as spaced distances a and b.

During operation of the tank mixing system, when the pump 60 is withdrawing the tank contents 70 through the sump 52 and discharging the tank contents 70 through the mixing nozzles 38, one or more flow patterns may develop. The flow patterns may assist in moving the contents 70 of the tank in order to suspend the solid components 74 in the liquid components 76 of the tank contents 70. The flow patterns may be partly or completely random, or may be a general pattern having approximately repeating portions along with random fluid flows.

When substantial amounts of solid components 74 are present in a tank 20, such as when the tank 20 has not been mixed for a substantial period of time, large debris pieces 78 of the solid components 74 can rise to the surface of the tank 20 due to agitation with the discharge stream from the mixing nozzles 38. Some of these solid debris pieces 78 may float at or near the surface 72 of the tank contents 70, and may float within a generally predeterminable ring around the tank 20. It has been found that the flow patterns or movement of the contents within typical tanks can cause the radial location of the floating solid debris pieces 78 to be generally predeterminable based upon a variety of factors, as discussed in greater detail in U.S. Pat. No. 6,821,011, the disclosure of which is hereby incorporated by reference in its entirety.

In order to beak up and/or mix the solid debris 78, one or more upper nozzles 40 are positioned above the surface 72 of the tank contents 70 for directing a stream of fluid to contact the solid debris 78. The upper nozzles 40 may be connected via piping 42 and 48 to the uppermost piping ring 32, and valves 44 may be used to permit selective operation of the upper nozzles 40. However, the upper nozzles 40 may be connected directly to the outlet of the pump 60. In order to not disrupt the rotational flow and fluid flow patterns 80 of the fluid contents 70 within the tank 20, it is preferred that the fluid streams exiting the upper nozzles 40 be directed in an angle generally tangent to and in the direction of rotation of the tank contents 70.

In a preferred embodiment of the tank mixing system for increased height tanks, the mixing nozzles 38 are positioned and oriented to create a first fluid pattern that is believed to include flow paths toward the outer surrounding wall 22 in the lower portion of the tank 20, flow paths upward in the outer portion of the tank 20, flow paths inward in the upper portion of the tank 20, and flow paths downward in the inner portion of the tank 20. In addition to the first fluid pattern, the mixing nozzles are also believed to be positioned to generate a second fluid pattern which is generally rotating. When the two fluid patterns are combined, the first fluid pattern may be present one or more times throughout the second, rotational flow pattern in the tank contents 70. Depending in part upon the height of the tank and the angle E of the mixing nozzles, the fluid flow upward in the outer portion of the tank may be in an upward, generally spiral flow, either of constant or variable pitch, which flow can be reinforced by mixing nozzles positioned at higher elevations.

The fluid patterns are preferably selected to at least partially counteract the fluid phenomena known as the tea-cup effect. During rotation of a body of fluid in a tank where the tea-cup effect is present, fluid flows tend to be upward in the inner portion of the tank, outward in the upper portion of the tank, downward in the outer portion of the tank, and inward in the lower portion of the tank. Due to the flow of fluid inward in the lower portion of the tank, solids may tend to accumulate in the center portion of the tank along the floor. When attempting to mix the contents of tank, it is desirable to move accumulated solids away from the center portion of the tank floor and suspend the solid components in the liquid components of the tank contents. Thus, in a preferred tank mixing system, the outward fluid flows in the lower portion of the tank 20, such as depicted in FIG. 1, are believed to counteract the tea-cup effect.

In the illustrated example of FIGS. 1 and 2, the tank 20 is about 136 feet height and has a maximum diameter of about 97 feet. Each of the three nozzle rings 32, 34 and 36 has six mixing nozzles 38 which are aimed at about an angle θ of between about 45 degrees and about 60 degrees, and more preferably at about 60 degrees. The lowermost ring is positioned at about 30 feet from the tank bottom, the middle ring is positioned at about 60 feet from the tank bottom, and the uppermost ring is positioned at about 90 feet from the tank bottom.

Turning to more of the details of the tanks 20, each of the tank mixing systems may include a generally circular tank 20 having an upstanding, outer surrounding wall 22 extending upward around the circumference of the tank 20 from a tank floor 24. However, the tank 20 may not be circular, but may be, for example, ovular or rectangular. Some tanks may be silo shaped, and others egg shaped. The tank 20 may be located above ground, or may be partially or completely disposed below ground level. The outer surrounding wall 22 may be formed of concrete, although other materials and methods may be used for forming the tank outer surrounding wall, such as metal sections or fiberglass. The tank floor 24 is preferably formed of concrete, although other suitable floor materials may be used. The floor 24 of the tank 20 may be generally planar, or alternatively may include a conical region sloping downward to the center of the tank 20, as illustrated in FIG. 1. The tanks 20 may have a capacity of up to between about 2,000,000 gallons and about 5,000,000 gallons, and may have heights of up to 80 feet and beyond.

When the fluid flow is in the outer portion of the tank 20, the outer surrounding wall 22 is believed to have the effect of causing some of the fluid in the flow path to travel upward toward the upper portion of the tank 20. The angle θ relative to a horizontal plane at which the fluid is discharged from the mixing nozzles 38 determines in part the particular characteristics of the generally upward flow path. For example, a lesser angle θ is believed to result in the fluid flow path turning upward close to the outer surrounding wall 22. Conversely, a larger angle E can result in the fluid flow path gradually moving upward to a larger extent.

In the upper portion of the tank 20, fluid is believed to travel in a flow path from the outer portion of the tank 20 to the inner portion of the tank 20. Some of the fluid may be traveling close to the surface 72 of the tank contents 70, and can create visible indications of the fluid flow on the surface of the tank contents 70. Depending in part upon the momentum of the solid and liquid components 74 and 76 in the generally upward flow path in the outer portion of the tank 20, it is believed that the flow paths inward in the upper portion of the tank 20 may be partially horizontal or may be downward from the outer portion of the tank 20 toward the inner portion of the tank 20. For example, if the momentum of the components 74 and 76 is larger, then the flow paths may be partially horizontal. If the momentum of the components 74 and 76 is lower, then the upper flow path may be inclined downward from the outer portion of the tank 20 toward the inner portion of the tank 20. The descending flows in the center portion of the tank 20 can have eddies that form therebetween, which can further assist in mixing of the tank contents 70.

Thus, as evident in FIG. 1, generalized flow paths are believed to extend toward the outer surrounding wall in the lower portion of the tank 20, upward in the outer portion of the tank 20, inward in the upper portion of the tank 20, and downward in the inner portion of the tank 20. The flow paths of the first flow pattern may repeat one or more times, or less than one time, during rotation of the tank contents due to the second or rotational flow pattern.

Several factors related to the mixing nozzles 38 determine the extent and magnitude to which the flow patterns are developed. For instance, the diameter of the nozzle opening, the angle θ of the nozzle discharge, the number of nozzles 30, the radial position of the nozzles 38 and the elevations of the nozzles 38 from the tank floor 24 can effect the flow patterns within the tank 20. Other factors that determine the extent and magnitude to which the flow patterns are developed, include the tank height and diameter, the energy gradient within the tank 20, and the characteristics of the tank contents 70.

As can be appreciated from the above description of FIGS. 1 and 2, there is provided a new improved method and apparatus for mixing the liquid and solid components 74 and 76 of the contents 70 of a tank, and in particular a tank 20 having an increased height, using a tank mixing system having at least one submerged flow generating device, such as nozzles 38, positioned proximate the outer wall of the tank and directed in a generally upward direction between directly horizontal and directly vertical. While there have been illustrated and described particular embodiments, it will be appreciated that numerous changes and modifications will occur to those skilled in the art, and it is intended in the appended claims to cover all those changes and modifications which fall within the true spirit and scope thereof.

The invention claimed is:

1. A system for mixing liquid and solid components of contents of a tank, the system comprising:

a tank having an increased height and an outer wall, the outer wall having a height greater than a width of the tank, the tank configured to be at least partially filled with the contents;

a sump positioned adjacent a floor of the tank;

a pump having an inlet operatively connected to the sump, and an outlet, the pump configured to withdraw at least some of the contents of the tank from the sump and discharge the at least some of the contents into the tank; and piping fluidly connected to the outlet of the pump, elevated from a floor of the tank, and secured to one of the outer wall and a roof of the tank, at least one submerged flow generating device secured on the piping and positioned within the tank to be submerged in the contents and operatively connected to the outlet of the pump through the piping, the at least one submerged flow generating device directed at an upwardly-inclined angle and constructed and arranged to discharge the at least some of the contents of the tank, the upwardly-inclined angle selected to generate a first fluid flow pattern of the at least some of the contents of the tank that is generally rotational about a central vertical axis of the tank and a second fluid flow pattern of the at least some of the contents of the tank including an upwardly directed flow in an outer region of the tank.

2. The system for mixing liquid and solid contents of a tank in accordance with claim 1, wherein a plurality of submerged flow generating devices are secured on the piping.

3. The system for mixing liquid and solid contents of a tank in accordance with claim 2, wherein the plurality of submerged flow generating devices are positioned at a radial distance of greater than 75% and less than 100% of a distance from a center of the tank to the outer wall of the tank.

4. The system for mixing liquid and solid contents of a tank in accordance with claim 3, wherein the plurality of submerged flow generating devices are positioned at different elevations in the tank.

5. The system for mixing liquid and solid contents of a tank in accordance with claim 4, wherein at least one of the plurality of submerged flow generating devices comprises a nozzle and a nozzle is provided for about every 300,000 gallons of tank volume.

6. The system for mixing liquid and solid contents of a tank in accordance with claim 5, wherein nozzles are separated by between about 30 feet and about 50 feet vertically.

7. The system for mixing liquid and solid contents of a tank in accordance with claim 6, wherein a lowest group of nozzles is between about 25 feet and about 35 feet above a lowest point in the tank.

8. The system for mixing liquid and solid contents of a tank in accordance with claim 4, wherein the plurality of submerged flow generating devices are configured to direct fluid flow generally inward in an upper portion of the tank, generally downward in a center portion of the tank, and generally outward in a lower portion of the tank.

9. The system for mixing liquid and solid contents of a tank in accordance with claim 2, wherein an upper flow generating device is positioned above a level in the tank to which the tank is configured to be filled and directed downwardly toward the tank, the upper flow generating device being operatively connected to the pump.

10. The system for mixing liquid and solid contents of a tank in accordance with claim 9, wherein the plurality of submerged flow generating devices are configured to create a fluid flow within the tank having a flow moving the tank contents in a direction of rotation along with a generally inward component and a generally outward component proximate a surface of the tank contents, the generally inward and outward components of the fluid flow meeting in a region of the tank, and the upper flow generating device being positioned to direct a fluid stream onto the surface generally at the region of the tank where the generally inward and outward components of the fluid flow meet.

11. The system for mixing liquid and solid contents of a tank in accordance with claim 1, wherein the at least one submerged flow generating device is disposed adjacent a sidewall of the tank.

12. The system for mixing liquid and solid contents of a tank in accordance with claim 11, wherein a plurality of flow generating devices in the form of nozzles are provided, the nozzles being positioned to discharge fluid in a generally upward direction at an angle of between about 45 degrees and about 60 degrees from horizontal.

13. A system for mixing liquid and solid components of contents of a tank, the system comprising:

a tank having an increased height and an outer wall, the outer wall having a height greater than a width of the tank, the tank configured to be at least partially filled with the contents;

a sump positioned adjacent a floor of the tank;

a pump having an inlet operatively connected to the sump, and an outlet, the pump configured to withdraw at least some of the contents of the tank from the sump and discharge the at least some of the contents into the tank;

a first section of piping fluidly connected to the outlet of the pump and elevated from a floor of the tank, a first plurality of flow generating devices positioned to be submerged in the contents of the tank on the first section of piping adjacent to the outer wall of the tank; and a second section of piping positioned above the first section of piping and fluidly connected to the outlet of the pump, a second plurality of flow generating devices positioned to be submerged in the contents of the tank on the second section of piping adjacent to the outer wall of the tank;

the first plurality of flow generating devices being fluidly connected to a discharge of the pump through the first section of piping, at least one of the first plurality of submerged flow generating devices directed at an upwardly-inclined angle, the upwardly-inclined angle selected to generate a first flow pattern of the contents of the tank having a generally rotational component about a central vertical axis of the tank and a second flow pattern of the contents of the tank being generally upward in an outer portion of the tank, generally inward in an upper portion of the tank, generally downward in a center portion of the tank, and generally outward in a lower portion of the tank, and the second plurality of flow generating devices being fluidly connected to a discharge of the pump through the second section of piping, at least one of the second plurality of submerged flow generating devices directed at an upwardly-inclined angle, the upwardly-inclined angle selected to generate a first flow pattern of the contents of the tank having a generally rotational component about a central vertical axis of the tank and a second flow pattern of the contents of the tank being generally upward in the outer portion of the tank, generally inward in the upper portion of the tank, generally downward in the center portion of the tank, and generally outward in the lower portion of the tank.

14. The system for mixing liquid and solid contents of a tank in accordance with claim 13, wherein a plurality of submerged flow generating devices are positioned on a plurality of pipes positioned at different elevations in the tank.

15. The system for mixing liquid and solid contents of a tank in accordance with claim 14, wherein the plurality of submerged flow generating devices comprise nozzles and at least one nozzle is provided for about every 300,000 gallons of tank volume.

16. The system for mixing liquid and solid contents of a tank in accordance with claim 15, wherein the plurality of pipes are separated by between about 30 and about 50 feet vertically.

17. The system for mixing liquid and solid contents of a tank in accordance with claim 16, wherein a lowest of the plurality of pipes is between about 25 and about 35 feet above a lowest point in the tank.

18. The system for mixing liquid and solid contents of a tank in accordance with claim 13, wherein an upper flow generating device is positioned above a fluid level to which the tank is configured to be filled and directed downwardly toward the tank, the upper flow generating device being operatively connected to the pump.

19. The system for mixing liquid and solid contents of a tank in accordance with claim 18, wherein the submerged flow generating devices are configured and arranged to create a fluid flow within the tank having a flow moving the tank contents in a direction of rotation about a central vertical axis of the tank along with a generally inward component and a generally outward component proximate the surface of the tank contents, the generally inward and outward components of the fluid flow meeting in a region of the tank, and the upper flow generating device being positioned to selectively direct a fluid stream onto the surface generally at the region of the tank where the generally inward and outward components of the fluid flow meet.

20. The system for mixing liquid and solid contents of a tank in accordance with claim 13, wherein a plurality of flow generating devices in the form of nozzles are provided, the nozzles being positioned to discharge fluid in a generally upward direction between directly horizontal and directly vertical.

21. The system for mixing liquid and solid contents of a tank in accordance with claim 20, wherein the nozzles are orientated to discharge fluid at an angle of between about 45 degrees and about 60 degrees from horizontal.

22. A system for mixing liquid and solid components of contents of a tank, the system comprising:

a tank having an increased height and having a sidewall, the sidewall having a height greater than a width of the tank;

a plurality of nozzles disposed on a lower pipe elevated from a floor of the tank, the nozzles on the lower pipe being disposed adjacent the sidewall of the tank and directed at an upwardly-inclined angle, the upwardly-inclined angle selected to generate a fluid flow pattern of the contents of the tank that is generally upward proximate the sidewall of the tank, the nozzles on the lower pipe being disposed at an elevation of between about 25 feet and about 35 feet from a lowermost point in the tank;

a sump configured to withdraw the contents from the tank;

one or more pumps having an inlet operatively connected to the sump and configured to withdraw the contents from the tank through the sump and discharge the contents through the lower pipe and the nozzles; and a plurality of nozzles disposed on an upper pipe spaced from the lower pipe, the nozzles on the upper pipe being disposed adjacent the sidewall of the tank and positioned to discharge fluid supplied by the pump through the upper pipe at an upwardly-inclined angle, the nozzles on the upper pipe being disposed at an elevation of between about 30 feet and about 50 feet from the nozzles on the lower pipe.

* * * * *